United States Patent [19]

Small

[11] 4,299,276

[45] Nov. 10, 1981

[54] HEAT EXCHANGER HAVING RADIAL SUPPORT

[75] Inventor: William M. Small, Bartlesville, Ohio

[73] Assignee: Phillips Petroleum Company, Bartlesville, Okla.

[21] Appl. No.: 142,186

[22] Filed: Apr. 21, 1980

[51] Int. Cl.[3] ..... F28F 9/00

[52] U.S. Cl. ..... 165/162

[58] Field of Search ..... 165/109, 159, 161, 162, 165/172, 160; 122/510

[56] References Cited

U.S. PATENT DOCUMENTS

| | | | |
|---|---|---|---|
| 1,882,474 | 10/1932 | Black | 165/162 |
| 2,229,344 | 1/1941 | Schneider | 165/162 |
| 2,937,079 | 5/1960 | Van Pool | 165/159 X |
| 3,708,142 | 1/1973 | Small | 165/162 |
| 3,749,160 | 7/1973 | Vestre | 165/160 |
| 3,967,677 | 7/1976 | Mohlman | 165/162 |
| 4,013,121 | 3/1977 | Berger et al. | 165/162 |
| 4,120,350 | 10/1978 | Norton | 165/162 |
| 4,127,165 | 11/1978 | Small | 165/162 |

*Primary Examiner*—Sheldon J. Richter

[57] ABSTRACT

A heat exchanger has the tube sections supported by one or more units comprising a cylinder section surrounding the bundle of tube sections and having rods forming a rod baffle attached to each of its two opposing faces. In another embodiment, the tube sections are surrounded along a substantial porton of their length by a shroud cylinder having a plurality of rod baffles attached thereto. The shroud cylinder can be composed of a plurality of cylinder sections having recesses in their opposing faces so that abutting faces of adjacent shroud cylinder sections have facing pairs of recesses which correspond in shape essentially to the shape of the end of the rods of a rod baffle.

13 Claims, 11 Drawing Figures

HEAT EXCHANGER HAVING RADIAL SUPPORT

Figure 1:
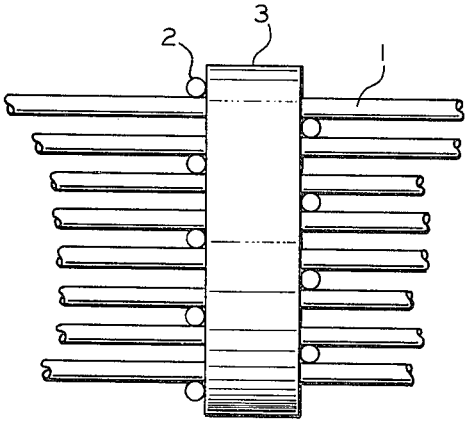

This invention relates to rod baffle supports of tube sections in heat exchangers. More specifically, the present invention relates to a simple integral unit of two or more rod baffles supporting the tube section series of a heat exchanger.

BACKGROUND OF THE INVENTION

Rod baffle supports for tube and shell heat exchangers have attracted considerable interest in recent years. These heat exchangers have the advantage of having both efficient heat transfer characteristics and flow properties.

In one prior art rod baffle heat exchanger the rods of two rod baffles are connected their end portions with a frame-like structure of oblique external rods. In another heat exchanger, the end portions of the rods of a rod baffle are sandwiched between two disc-like members to support them, see U.S. Pat. No. 4,127,165.

Welding the rods of a rod baffle to an outside ring-shaped support rod or to a frame of outside surrounding support rods necessitates bending of outsides rods to the proper shape or respectively warping of outside framework structures due to the heat of welding.

STATEMENT OF THE INVENTION

It is one object of this invention to provide a rod baffle unit useful in tube and shell heat exchangers that is sturdy and simple.

Another object of this invention is a rod baffle unit for a heat exchanger which can be readily manufactured.

A further object of this invention is a heat exchanger built out of relatively inexpensive units and elements.

Still another object of this invention is to provide a simple means for attaching rods of a rod baffle to a surrounding support when the rod baffle is arranged in a slanted manner with respect to heat exchanger tube sections.

A still further object of this invention is to provide a tube and shell heat exchanger which is sturdy enough to stand significant outside impact and can be used under increasingly severe security requirements in such applications as nuclear power plants.

These and other objects, advantages, details, features and embodiments of this invention will become apparent to those skilled in the art from the following detailed description of the invention, the appended claims and the drawing in which Inside of the shell 4 a shroud cylinder 30 is arranged.

Figure 1A:
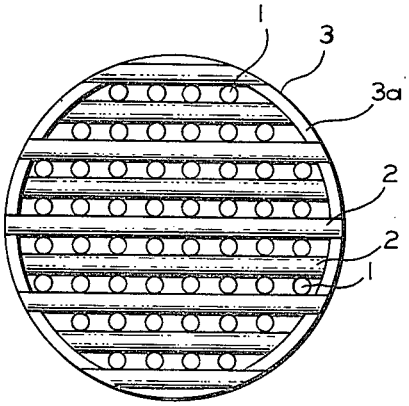
Figure 2:
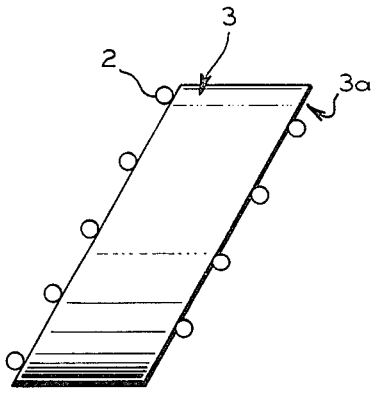
Figure 3:
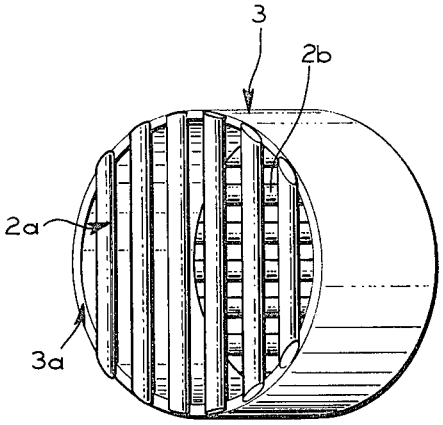
Figure 4:
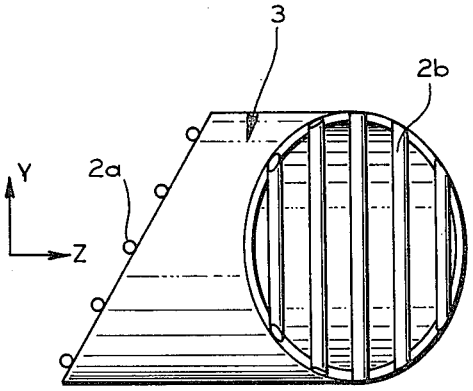
Figure 5:
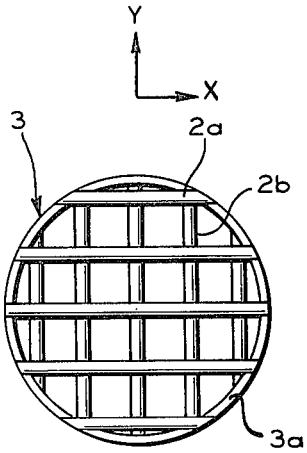
Figure 6:
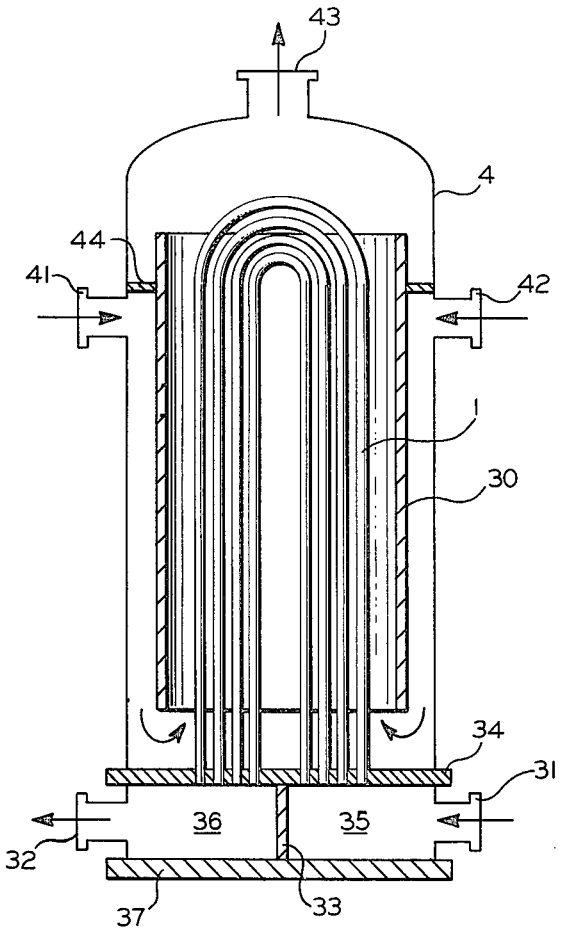
Figure 7:
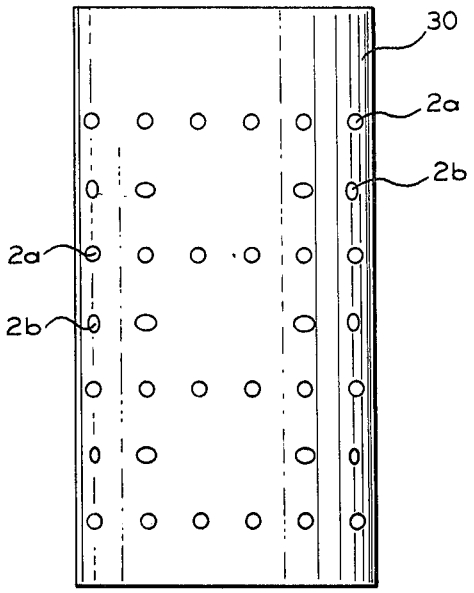
Figure 8:
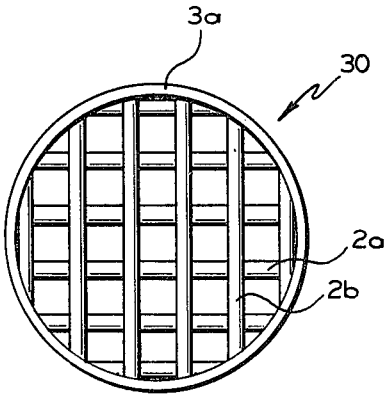
Figure 9:
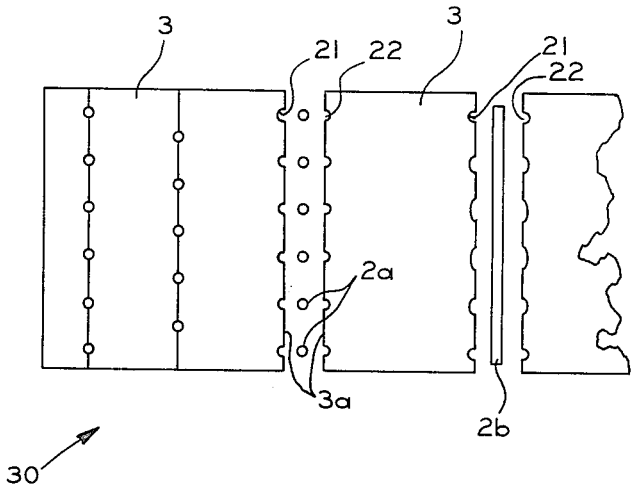
Figure 10:
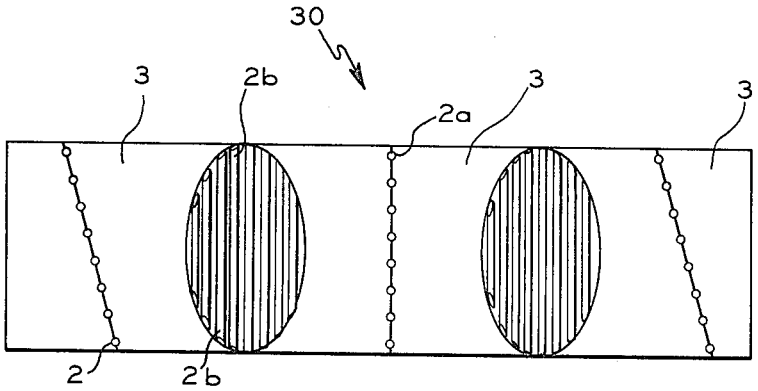

FIGS. 1 and 1*a* are two views of a rod baffle unit with heat exchanger tube sections, FIGS. 2 and 3 each is a view of a further embodiment of a rod baffle unit, FIGS. 4 and 5 are two views of the same rod baffle unit in accordance with another embodiment of this invention, FIG. 6 is a schematical cross-sectional view of a heat exchanger with a shroud cylinder, FIGS. 7 and 8 are two views of the shroud cylinder employed in FIG. 6, FIGS. 9 and 10 show two embodiments of a shroud cylinder built out of cylinder segments, the cylinder segments being in part shown separated in FIG. 9.

In accordance with this invention a heat exchanger is provided which comprises a bundle of mutually parallel tube sections, a set of rod baffles and one or more support cylinders. The tube sections of the heat exchanger have essentially identical cross section. The set of rod baffles comprises at least a first and a second rod baffle. Each rod baffle comprises a plurality of mutually parallel rods. Rods of the first rod baffle and the rods of the second rod baffle in one set of rod baffles are arranged at a substantial angle to each other. All of the rods are arranged between tube section rows. There is at least one tube section row arranged between each pair of adjacent parallel rods of one rod tube section. In accordance with this invention a support cylinder surrounds the tube section bundle. This support cylinder has a first face and a second face. The rod end portions of the rods of one rod baffle are rigidly connected to the first face and correspondingly the rod end portions of the rods of another rod baffle are rigidly connected to the second face. The support cylinder having the rods attached to each of its faces thus provides a sturdy and rigid unit of two rod baffles rigidly connected with each other. One of the significant advantages of this invention resides in the fact that such a support cylinder is readily manufactured by cutting a section from a cylinder of the given diameter and the rods can be easily attached to this cylinder by spot welding. Such a cylinder is less subject to warping than a ring made from a rod.

The heat exchanger in accordance with this invention can also be described in geometrical terms. The tube sections are mutually parallel and are arranged both in at least a first series of plane parallel rows of tube sections and in a second series of plane parallel rows of tube sections. Between adjacent tube section rows of the first series and of the second series a gap remains. These gaps are at least as wide as the rods of the rod baffles and preferably exactly that size. At least one set of rod baffles comprising at least a first and a second rod baffle is arranged to support the tube sections in such a manner that each rod baffle comprising a plurality of parallel rods is arranged in the gaps mentioned. Any two rods of one rod baffle has at least one row of tube sections between them. The rods of the first rod baffle are arranged in the gaps between the rows of the first series of plane parallel rows of tube sections and correspondingly the rods of the second rod baffle are arranged in the gaps between the rows of the second series of plane parallel rows of tube sections. The set of rod baffles provides radial support for all of the tube sections.

Radial support in all of the embodiments of this invention means that a tube section cannot be moved in a direction orthogonal to its longitudinal axis. At least three rods are necessary to provide radial support for one tube section. One rod can and normally does support more than one tube section.

In accordance with another embodiment of this invention a heat exchanger comprising a rigid tube section unit surrounded by a shroud cylinder is provided. This heat exchanger comprises a bundle of tube sections as defined above in connection with the other embodiments of this invention. These tube sections are surrounded by a shroud cylinder. The shroud cylinder surrounds the tube sections along a substantial portion of their length, usually along substantially their entire length. The tube sections are supported by a plurality of rod baffles providing radial support for each tube section. The rod baffles in this embodiment also consist of a group of mutually parallel rods having at least one plane row of tube sections arranged between adjacent rods of one baffle. The rods of rod baffles each have two opposite ends which are rigidly connected to the shroud cylinder. The rods and the shroud cylinder together thus form one solid self-supporting sturdy unit of tube sections, rod baffles and shroud cylinder.

The heat exchanger of this invention is provided with a shell surrounding the self supporting unit composed of the tube sections, the rod baffles and the shroud cylinder. The shell is provided with shell inlet means allowing fluid to pass into the shell and flow through the shroud cylinder and into contact with the tube sections. The shell is also provided with shell outlet means for allowing the fluid to leave the shell after having flown through said shroud cylinder. At least one tube section sheet is provided for which has a shell side and an outer side. The tube section sheet closes the shell and provides flow passages for another fluid to flow from the outer side of the tube section sheet through the tube sections. The fluid flowing through the tube sections can either return through the same tube section sheet in case of the tube sections being essentially u-shaped or the fluid can leave the tube sections by means of a second tube section sheet arranged opposite to the first tube section sheet and closing the shell on the opposite side.

The shroud cylinder in accordance with this invention is preferably built out of a plurality of cylinder sections. These cylinder sections can basically have the same structure and the rods can be geometrically arranged the same way with respect to the cylinder sections whether they constitute a portion of the shroud cylinder or whether they are the support cylinder sections in accordance with the first embodiment of this invention. The main difference between the shroud cylinder sections and the individual cylinder sections resides in the fact that the shroud cylinder sections have faces that are essentially shaped and arranged to match the corresponding faces of the adjacent shroud cylinder section. Between abutting faces of adjacent shroud cylinder section there is only a small or essentially no axial distance. Preferably the abutting faces of adjacent shroud cylinder sections are provided with recesses which are shaped and distributed along the circumference of the shroud cylinder section faces so that pairs of recesses of adjacent abutting faces of shroud cylinder sections form an opening to support an end portion of a rod when the two adjacent abutting faces of the shroud cylinder sections are in their closest position. The shape and arrangement of the abutting recesses in abutting faces of adjacent shroud cylinder sections is defined by the geometrical intersection between the rod end portion surface and the shroud cylinder.

The following description of preferred geometrical shapes and arrangements for the faces of the cylinder sections and the rods applies to both the first described embodiments of this invention concerning generally a support cylinder arrangement with parallel rods of a rod baffles on each face thereof and also to the second embodiment of this invention wherein a plurality of cylinder sections put together form the shroud cylinder. The only distinction between the two embodiments is that for the second embodiment the shroud cylinder sections are provided with recesses which are not a necessary feature, but a possible feature for the first described embodiments.

The two faces of the cylinder sections supporting rods of rod baffles are essentially plane. The two opposing faces of one cylinder section may be and preferably are parallel. The simplest construction is achieved when one or both of the opposing faces of the cylinder section is arranged at 90° with respect to the axis of the two sections.

For certain applications where the generation of a specific flow pattern or the utmost reduction of flow resistivity is desired, it may be preferable to arrange at least one of the opposing faces of a cylinder section at an angle between 20° and 70° with respect to the axis of the tube sections. The plane face of such a cylinder section and the planes defined by the axis of tube sections belonging to one group of parallel tube section row intersect in parallel lines which preferably are essentially orthogonal to the axis of the tube sections. The rods are preferably arranged along those lines and thus under 90° to the tube sections in all of the rod baffles.

Preferably, at least one rod baffle has one rod arranged in each gap between adjacent parallel tube section rows of one series of rows. If a further increase in flow and throughput through the heat exchanger is desired, the baffles can be structured and arranged so that one rod baffle has one rod arranged in every other gap between adjacent tube rows of one series of rows and so that a further rod baffle has one rod arranged in each of those gaps between adjacent tube section rows of the same series where no rods of the first mentioned rod baffle are arranged. These two rod baffles together provide a rod between each adjacent parallel tube section row but the two rod baffles are axially located at different positions. The two rod baffles preferably are axially adjacent to each other. In connection with the first embodiment of this invention the end portions of the rods of the one baffle are attached to the first face of the cylinder section and the end portions of the rods of the second baffle are attached to the second face of the cylinder section.

The geometrical arrangement of the tube sections can be such that the projection of the tube cross sections into a plane orthogonal to the tube axis is in any two dimensionally periodic pattern allowing at least two groups of parallel rods to be inserted between tube section rows the rods of each group of rods being at a substantial angle with each other but orthogonal to the tube section axis and adjacent rods of one rod baffle having at least one row of parallel tube sections of a first series of parallel tube section rows between them whereas adjacent rods of the other baffle have a different row of tube sections of a second series of parallel tube section rows between them.

The preferred pattern of arrangement of tube sections is such that there is a first series of rows of parallel tube sections defining a first series of planes through the axis of the respective tube sections and a second series of rows of parallel tube sections defining a second series of parallel planes through the respective axis of tube sections with the proviso that the fist series of planes and the second series of planes is at 90° with respect to each other. The simplest way and the presently preferred manner of achieving this geometrical arrangement is to have the projection of the axis of the tube sections into a plane orthogonal to these axis form a pattern of identical squares as formed by the lined intersections of regular drafting paper. Another pattern of arrangement of tube sections which may be preferred when smaller rods and denser packing of the tube sections is desired is defined by a pattern of equilateral triangles. The tube sections are arranged in each of three series of rows of parallel tube sections. Each series of rows defines a series of equidistant parallel planes, each plane containing the axis of the tube sections of one row. Each series of these equidistant parallel planes intersects the other two series of equidistant parallel planes at essentially 60°. The gap between adjacent tube rows in each series is the same for all three series of rows. The distance between the equidistant parallel planes essentially equals the sum of the outside diameter of the tube section and the diameter of a rod. The gap between the adjacent tube section rows thus is essentially as wide as a rod.

The present invention is not limited to any specific materials. Preferably, however, both the cylinder sections, the rods and the tube sections are made from metallic materials. The actual metals used will largely depend upon the thermal conductivity requirements and the temperatures under which the heat exchanger is to be utilized. Furthermore the fluids flowing through the heat exchanger will be a determining factor of the choice of materials. For heat exchangers used in connection with essentially non-corrosive fluids, steel is a good material to be used for these elements. The rods are attached to the faces of the cylinder sections by spot welding. In case of the shroud cylinder being built out of individual cylinder sections the circumference of adjacent cylinder sections is also closed by a welding seam.

The invention will be still more fully understood by the following description of the drawings.

FIGS. 1 and 1A show a front and an axial partial view of tube sections 1 supported by two rod baffles consisting of rods 2 welded to the opposing faces 3*a* of a supporting cylinder section 3. The rods 2 in FIGS. 1 and 1A are arranged in such a way that the unit is formed out of two baffles and each of these baffles has a rod arranged only in every other gap between adjacent parallel tube section rows. The unit shown in FIGS. 1 and 1A does not yet provide radial support for all of the tube sections. In order to achieve that two of such units would be required having their rods arranged at 90° with respect to each other.

Another embodiment of this invention is shown in FIG. 2. The tube sections 1 are not shown in FIG. 2 but can be readily visualized as being arranged in essentially the horizontal direction. To arrange a rod baffle with the rods at 90° with respect to the tube section axis but having the rod baffle plane at an angle substantially different from 0° or 90° with respect to the tube section axis heretofore was a mechanical problem. In accordance with this invention and the embodiment shown in FIG. 2 a cylinder section 3 readily provided by cutting such a section from a larger cylinder under the angle desired achieves the goal. The rods 2 are readily welded to the faces 3*a* of cylinder 3. The oblique arrangement of the rod baffles achieves a further reduction in pressure drop across the heat exchanger.

Another embodiment of the invention is shown in FIG. 3. Rods 2*a* of a first rod baffle are attached to a cylinder section 3 whereas rods 2*b* of a second rod baffle are arranged at 90° with respect to the rods 2*a*. Such a unit can provide radial support for all of the tube sections by itself if the rods 2*a* are arranged in each gap of adjacent tube section rows and the rods 2*b* are also arranged in adjacent gaps between the tube section rows.

If desired, the cylinder section 3 can be shaped so that the rods 2*a* of the rods baffle arranged with one of its faces 3*a* are at 90° with respect to the rods 2*b* of the other face of the cylinder section 3. However, the two faces 3*a* of the cylinder section 3 are neither parallel to each other nor are they at 90° with respect to the z-axis which is the axis of the tube sections. Such an arrangement is shown in FIGS. 4 and 5. Both faces of this double-obliquely cut cylinder section 3 are eliptical faces if the cylinder 3 is a circular cylinder as indicated in FIG. 5.

The second embodiment of this invention is illustrated in FIGS. 6–10. This embodiment of the invention involves a shroud cylinder 30 supporting the rods 2*a* and 2*b* of the various rod baffles.

In FIG. 6 an example of a heat exchanger in accordance with this embodiment of the invention is shown. The tube sections 1 are essentially U-shaped hairpin tubes. These hairpin tubes are welded into a tube section sheet 34 defining the shell side of the heat exchanger at the lower end. Below the sheet 34 two compartments 35 and 36 separated by a separating wall 33 are provided for. Each U-shaped tube section has one of its ends in fluid communication with chamber 35 and the other one of its ends in fluid communication with chamber 36. Thus, fluid entering chamber 35 through inlet 31 will flow through the U-shaped tube sections 1 and leave via chamber 36 and outlet 32. The two chambers 35 and 36 are closed at the bottom by a plate 37.

Inside of the shell 4 a shroud cylinder 30 is arranged. This shroud cylinder is shown in some more detail in FIGS. 7 and 8 together with the rods 2*a* and 2*b*. Rods 2*a* and 2*b* are arranged at 90° with respect to each other and support the tube sections. The rods are welded to the shroud cylinder. A ring-shaped deflector plate 44 is arranged inside of the shell 4 and forms an essentially fluid tight connection between the shell 4 and the shroud cylinder 30 directing fluid entering through one of the entries 41 and 42 into the inside of the shell toward the bottom thereof and up through the shroud cylinder 30 and into contact with the U-shaped tube sections to achieve heat exchange indirectly between the fluid entering through entries 41 and 42 and the fluid entering through inlet 31 and flowing through the tube sections. The fluid flowing through the shroud cylinder leaves via outlet 43.

Rather than having a shroud cylinder consisting of one piece as shown in FIGS. 7 and 8 the preferred embodiment of this invention utilizes a shroud cylinder 30 composed of a plurality of shroud cylinder sections 3 as shown in FIGS. 9 and 10. FIG. 9 shows cylinder sections 3 having both of its faces 3*a* essentially at 90° with respect to the shroud cylinder axis and the tube section axis. For illustration purposes some of the cylinder sections are shown in FIG. 9 in pulled apart position to show the recesses 21 and 22 which are arranged and shaped in a complementary way to support the ends of the rods 2*a* and 2*b* respectively.

FIG. 10 shows an arrangement of the shroud cylinder which is composed of cylinder sections 3 having faces 3*a* (not shown on drawing) which in part are arranged at angles different from 90° with respect to the axis of the tube sections. It will be noted that although these faces 3*a* are arranged at significant angles with respect to the cylinder axis, the rods in all of the baffles are arranged at 90° with respect to the tube section axis or respectively the shroud cylinder axis.

Reasonable variations and modifications which will become apparent to those skilled in the art will be made in this invention without departing from the spirit and scope thereof.

I claim:

1. A heat exchanger comprising (a) a bundle of mutually parallel tube sections of essentially identical cross section, (b) at least one set of rod baffles comprising at least a first and a second rod baffle, each rod baffle comprising a plurality of mutually parallel rods, the rods of the first rod baffle and the rods of the second rod baffle being arranged at a substantial angle to each other, each rod of the first rod baffle being arranged between adjacent rows of tube sections of a first series of rows and each rod of the second rod baffle being arranged between adjacent rows of tube sections of a secod series of rows the first series of rows being arranged at a substantial angle with respect to the second series of rows, and having at least one tube section row arranged between each pair of adjacent parallel rods, said set of rod baffles providing radial support for the tube sections, (c) at least one section of a support cylinder surrounding said tube section bundle and having a first plane face and a second plane face, the rod end portions of the rods of one rod baffle being rigidly connected to said first face and the rod end portions of the rods of another rod baffle being rigidly connected to said second face, thus providing a unit of two rod baffles rigidly connected, at least one of the faces being arranged at an angle between 20° and 70° with respect to the axis of the tube sections.

2. A heat exchanger comprising (A) a bundle of tube sections geometrically arranged as defined by (a) the tube sections being mutually parallel (b) the tube sections being arranged both in at least a first series of plane parallel rows of tube sections as well as in a second series of plane parallel rows of tube sections, the planes defined by the tube section axis of the first series arranged at an angle with respect to planes defined by the tube section axis of the second series, (c) a gap remaining between adjacent rows of tube sections of the first series and a gap remaining between adjacent rows of tube sections of the second series, (B) at least one set of rod baffles comprising at least a first and a second rod baffle, each rod baffle comprising a plurality of parallel rods arranged in said gaps, any two rods of one baffle having at least one row of tube section between them, the rods of said first rod baffle being arranged in the gaps between the rows of said first series of plane parallel rows of tube sections, and the rods of said second rod baffle being arranged in the gaps between the rows of said second series of plane parallel rows of tube sections, said set of rod baffles providing radial support for all of the tube sections, (C) at least one section of a support cylinder surrounding said bundle of tube sections and having a first plane face and a second plane face, said first face being rigidly connected to both end portions of each rod of one rod baffle and said second face of said cylinder being rigidly connected to both end portions of each rod of another rod baffle, providing a unit of two rod baffles rigidly connected, at least one of the faces being arranged at an angle between 20° and 70° with respect to the axis of the tube sections.

3. Heat exchanger in accordance with claim 1 or 2 wherein the planes of tube section rows intersect the plane defining said at least one of said opposite faces in parallel lines being essentially orthogonal to the axis of said tube sections and wherein said rods are arranged along said parallel lines.

4. A heat exchanger comprising (A) a bundle of tube sections geometrically arranged as defined by (a) the tube sections being mutually parallel (b) the tube sections being arranged both in at least a first series of parallel rows of tube sections as well as in a second series of plane parallel rows of tube sections, the two series of tube section rows arranged at an angle with respect to each other, (c) a gap remaining between adjacent rows of tube sections of the first series and a gap remaining between adjacent rows of the second series, (B) a shroud cylinder surrounding said bundle of tube sections along a substantial portion of their length, (C) a plurality of rod baffles, each rod baffle consisting essentially of a group of mutually parallel rods having at least one plane row of tube sections arranged between adjacent rods of one baffle, the rods of said plurality of rod baffles providing radial support for the tube section, and the rods of said plurality of rod baffles each having two opposite end portions rigidly connected to said shroud cylinder such as to form one solid, self supporting unit of tube sections, rod baffles and shroud cylinder, wherein said shroud cylinder is composed of a plurality of shroud cylinder sections, each section having two opposing faces, abutting faces of adjacent shroud cylinder sections being provided with recesses, mutually facing each other and shaped and arranged to support an end portion of the rod when the two abutting faces of adjacent shroud cylinder sections are in their closest position with the end portions of the rods arranged in pairs of recesses facing each other, (D) a shell surrounding said self supporting unit (E) shell inlet means for allowing a fluid to pass into said shell and flow through said shroud cylinder into contact with said tube sections, (F) shell outlet means for allowing said fluid to leave said shell after having flown through said shroud cylinder, (G) at least one tube section sheet having a shell side and an outer side and having said tube sections attached to said sheet in such a manner that a fluid may flow from the outer side of said tube section sheet into said tube sections and thus into indirect heat exchange with the fluid flowing through said shell and through said shroud cylinder.

5. Heat exchanger in accordance with claim 4 wherein shape and arrangement of abutting facing recesses is defined by the intersection between the rod end portion and the shroud cylinder.

6. Heat exchanger in accordance with claim 5 in which one of said two opposing faces is arranged at 90° with respect to the axis of the tube sections.

7. Heat exchanger in accordance with claim 4 wherein the two opposing plane faces of one cylinder section are essentially parallel to each other.

8. Heat exchanger in accordance with claim 4 wherein at least one rod baffle has one rod arranged in each gap between adjacent parallel rows of tube sections of one series of rows.

9. Heat exchanger in accordance with claim 4 wherein one rod baffle has one rod arranged in every other gap between adjacent tube rows of one series of rows and wherein a further rod baffle has one rod arranged in each of those gaps between adjacent tube rows of the same series in which no rods of said one rod baffle are arranged.

10. Heat exchanger in accordance with claim 9 wherein said section of said support cylinder has the end portions of the rods of said one baffle attached to its first face and has the end portions of the rods of said another baffle attached to its second face.

11. Heat exchanger in accordance with claim 4 wherein said first series of rows and said second series of rows of tube sections are at 90° with respect to each other and wherein all gaps between adjacent rows are essentially of the same width.

12. Heat exchanger in accordance with claim 1, 2 or 4 wherein each of three series of rows of tube sections is defined by a series of equidistant parallel planes, each plane containing the axis of tube sections of one tube section row wherein each series of equidistant parallel planes intersects the other two series of equidistant parallel planes at essentially 60° and wherein the size of said gap between adjacent tube rows in each series is the same for all three series of rows, and wherein each tube section belongs to all three series of rows.

13. Heat exchanger in accordance with claim 12 wherein the size of said gaps is equal to the diameter of said rods.

* * * * *